US009962056B2

(12) United States Patent
Zhu

(10) Patent No.: US 9,962,056 B2
(45) Date of Patent: May 8, 2018

(54) SELF-WRINGING FLAT MOP

(71) Applicant: Jiaxing Jackson Travel Products Co., Ltd., Jiaxing, Zhejiang (CN)

(72) Inventor: Xue Lin Zhu, Zhejiang (CN)

(73) Assignee: JIAXING JACKSON TRAVEL PRODUCTS CO., LTD., Jiaxing, Zhejiang (CN)

( * ) Notice: Subject to any disclaimer, the term of this patent is extended or adjusted under 35 U.S.C. 154(b) by 244 days.

(21) Appl. No.: 15/141,554

(22) Filed: Apr. 28, 2016

(65) Prior Publication Data

US 2016/0316984 A1 Nov. 3, 2016

(30) Foreign Application Priority Data

Apr. 30, 2015 (CN) ..... 2015 2 0278185 U
Apr. 30, 2015 (CN) ..... 2015 2 0280342 U

(51) Int. Cl.
*A47L 13/146* (2006.01)
*A47L 13/14* (2006.01)
*A47L 13/258* (2006.01)

(52) U.S. Cl.
CPC ..... *A47L 13/146* (2013.01); *A47L 13/14* (2013.01); *A47L 13/258* (2013.01)

(58) Field of Classification Search
CPC ..... A47L 13/14; A47L 13/142; A47L 13/146; A47L 13/254–13/258
See application file for complete search history.

(56) References Cited

U.S. PATENT DOCUMENTS 8,978,191 B2 * 3/2015 Yu ..... A47L 13/258 15/228
9,307,882 B2 * 4/2016 Zhu ..... A47L 13/142
2011/0239389 A1 10/2011 Ting
2015/0113750 A1 4/2015 Zhu

FOREIGN PATENT DOCUMENTS

TW M420300 U 1/2012

* cited by examiner

*Primary Examiner* — Shay Karls
(74) *Attorney, Agent, or Firm* — Muncy, Geissler, Olds & Lowe, P.C.

(57) ABSTRACT

A self-wringing flat mop includes a flat mop head, a mop handle and a holding sleeve. The mop handle includes a connection rod, a holding rod, and a transmission assembly. The holding rod is operated to rotate. The transmission assembly transmits rotation to the connection rod. The connection rod drives the flat mop head to collapse and wring out water. The transmission assembly includes a first engaging member and a second engaging member for undertaking engagement-disengagement actions. The holding rod includes a limiting rib. The holding sleeve sleeves the mop handle and includes a control lever. The control lever is turned pivotally with respect to the holding sleeve to separate the first engaging member from the second engaging member and restore the collapsed flat mop head to the flattened state. The holding sleeve includes a unidirectional limiting ring corresponding to the limiting rib.

16 Claims, 10 Drawing Sheets

SELF-WRINGING FLAT MOP

FIELD OF THE INVENTION

The present invention relates to a self-wringing flat mop, particularly to a self-wringing flat mop having a self-wringing feature and including a transmission assembly able to undertake engagement-disengagement actions.

BACKGROUND OF THE INVENTION

Nowadays, customers demand higher and higher performance to the household cleaning appliances. The traditional mops, which need manually wringing with hands, have been gradually rejected by customers because of unwholesomeness.

The related manufacturers had proposed various solutions to the abovementioned problem, including patents of TW M420300, US2011/239389 and U.S. Ser. No. 14/372,263 (published as US 2015-0113750 A1), the whole contents of which are expressly incorporate by reference in the present application for disclosure purposes. The patent U.S. Ser. No. 14/37,226 disclosed a self-wringing flat mop, which comprises a plate, a mop handle, a cleaning part, a rotation member, an outer ratchet, and a sleeve. The cleaning part is disposed under the plate. The plate includes a central plate and two side plates. Two ends of the central plate are respectively hinged with the two side plates via torsion springs. Two sides of the cleaning part are respectively connected with two outer sides of the side plates. The lower end of the rotation member is connected with a middle region of the cleaning part. The upper end of the rotation member is passed through a through-hole formed at the middle area of the plate and then non-rotatably connected with the mop handle. The outer ratchet sleeves the mop handle fixedly, and the sleeve spacer also sleeves the mop handle correspondingly. The inner wall of the sleeve includes an inner ratchet corresponding to the outer ratchet. The sleeve is non-rotatably connected with the upper area of the central plate. The user directly turns the mop handle to actuate the plate to collapse and wring water out of the cleaning part.

In practical operation, if the user should turn the mop handle with an inappropriate action, the mop may spin wholly. In such a case, the wringing effect would be degraded obviously.

SUMMARY OF THE INVENTION

The primary objective of the present invention is to solve the problem of the conventional self-wringing flat mop structure.

This problem is solved by a self-wringing flat mop as claimed by claim 1. Further advantageous embodiments are the subject-matter of the dependent claims.

To achieve the abovementioned objective, the present invention proposes a self-wringing flat mop, which comprises a flat mop head, a cleaning part, a mop handle, and a holding sleeve. The flat mop head further comprises a central plate and two side plates. Two sides of the central plate are respectively hinged with the two side plates via torsion springs. The central plate comprises a connection through-hole. Two ends of the cleaning part are respectively assembled to the two side plates. The cleaning part comprises an insertion-connection member corresponding to the connection through-hole, which is particularly inserted into the connection through-hole for connection. The mop handle further comprises a connection rod assembled to the central plate, a holding rod disposed coaxially with the connection rod, and a transmission assembly arranged between the connection rod and the holding rod. The connection rod comprises a control member penetrating the connection through-hole and connected with the insertion-connection member. The holding rod is operated by a user during operation to rotate, particularly to generate a rotating force exerted on downstream members. The transmission assembly transmits this rotation to the connection rod. The rotating connection rod turns the cleaning part through the control member to make (cause) the two side plates collapse and wring water out of the cleaning part. The transmission assembly comprises a first engaging member and a second engaging member, which are able to undertake engagement-disengagement operation. The first engaging member normally contacts the second engaging member. The rim of the first engaging member comprises a guiding member. The holding rod comprises a limiting rib. The holding sleeve is assembled corresponding to the transmission assembly and sleeves the mop handle. The holding sleeve further comprises a control lever pivotally installed with respect to the guiding member and a unidirectional limiting ring corresponding to the limiting rib. The control lever comprises a protruding trigger protruding from the holding sleeve and contacting the guiding member, and a levering element connected with the protruding trigger. The levering element is driven during operation to turn pivotally with respect to the holding sleeve and make the protruding trigger slide on the guiding member, whereby the first engaging member and the second engaging member are separated from each other. The unidirectional limiting ring comprises a plurality of ratchet teeth arranged annularly, particularly disposed along the circumference of the limiting ring at equiangular spacings, and facing the mop handle. The ratchet teeth confine the limiting rib to slide unidirectionally and confine the mop handle to turn in a single direction.

According to a further embodiment, the transmission assembly further may comprise a guiding rod; one end of the guiding rod is fixedly installed in the holding rod, and the other end of the guiding rod is fixedly installed in the second engaging member; the first engaging member sleeves the guiding rod and can move along the guiding rod to and fro.

According to a further embodiment, the mop handle further may comprise a first elastic element disposed in one side of the holding rod, which faces the first engaging member, and pressing against the first engaging member.

According to a further embodiment, the holding rod further may comprise a guiding ridged member facing the first engaging member; the first engaging member may comprise a guiding notched member facing the holding rod and matching the guiding ridged member.

According to a further embodiment, the holding rod further may comprise at least two first support poles and a bridging seat disposed between the two first support poles; wherein the bridging seat has an accommodation space, a limiting member disposed inside the accommodation space and extended far away from the accommodation space to form the limiting rib, and a second elastic element disposed inside the accommodation space and pressing against the limiting member.

According to a further embodiment, the connection rod may comprise at least one second support pole and a swivel joint connected with the second support pole and bridged with the central plate; wherein one side of the second support pole, which faces the second engaging member, comprises a positioning member used to fix the second engaging member; the second engaging member comprises a press-fit member corresponding to the positioning member; the swivel joint comprises a plurality of interlaced branch joints.

According to a further embodiment, the holding sleeve may further comprise a sleeve body where the control lever and the unidirectional limiting ring are disposed, a connection sleeve connected with the sleeve body, and a protection sleeve connected with the connection sleeve and pivotally coupled to the central plate for protecting the swivel joint.

According to a further embodiment, the control lever may further comprise a pivotal axis for pivotal coupling of the control lever and the holding sleeve, and a restoring spring sleeving the pivotal axis and providing resilience for the levering element.

According to a further embodiment, one side of the first engaging member, which faces the second engaging member, may comprise a first ratchet structure; one side of the second engaging member, which faces the first engaging member, may comprise a second ratchet structure.

In comparison with the conventional technology, the self-wringing flat mop according to the present invention particularly has the following characteristics and advantages:

According to the present invention a unidirectional limiting ring and a limiting rib are provided, which can substantially prevent from inappropriate spin of the mop handle in the wringing process. According to the present invention further a transmission assembly and a control lever are provided, whereby the flat mop can be easily restored to the original state after the wringing process. According to the present invention the user may be exempted from touching the cleaning part installed on the flat mop head, thus providing a wholesome solution to the conventional flat mop, particularly a more convenient operation for a user.

DETAILED DESCRIPTION OF THE PREFERRED EMBODIMENTS

Figure 1:
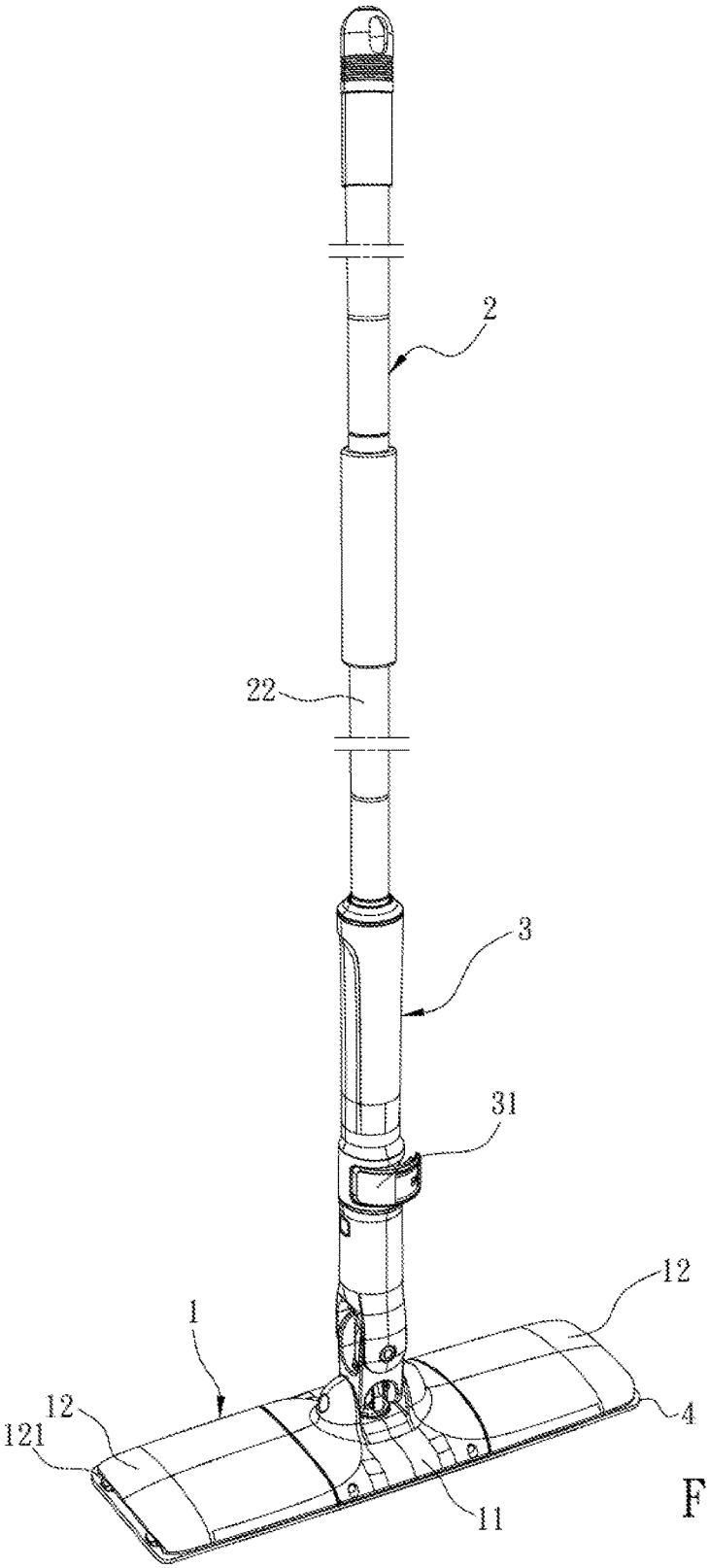
FIG. 1 is a perspective view schematically showing the appearance of a self-wringing flat mop according to one embodiment of the present invention.
Figure 2:
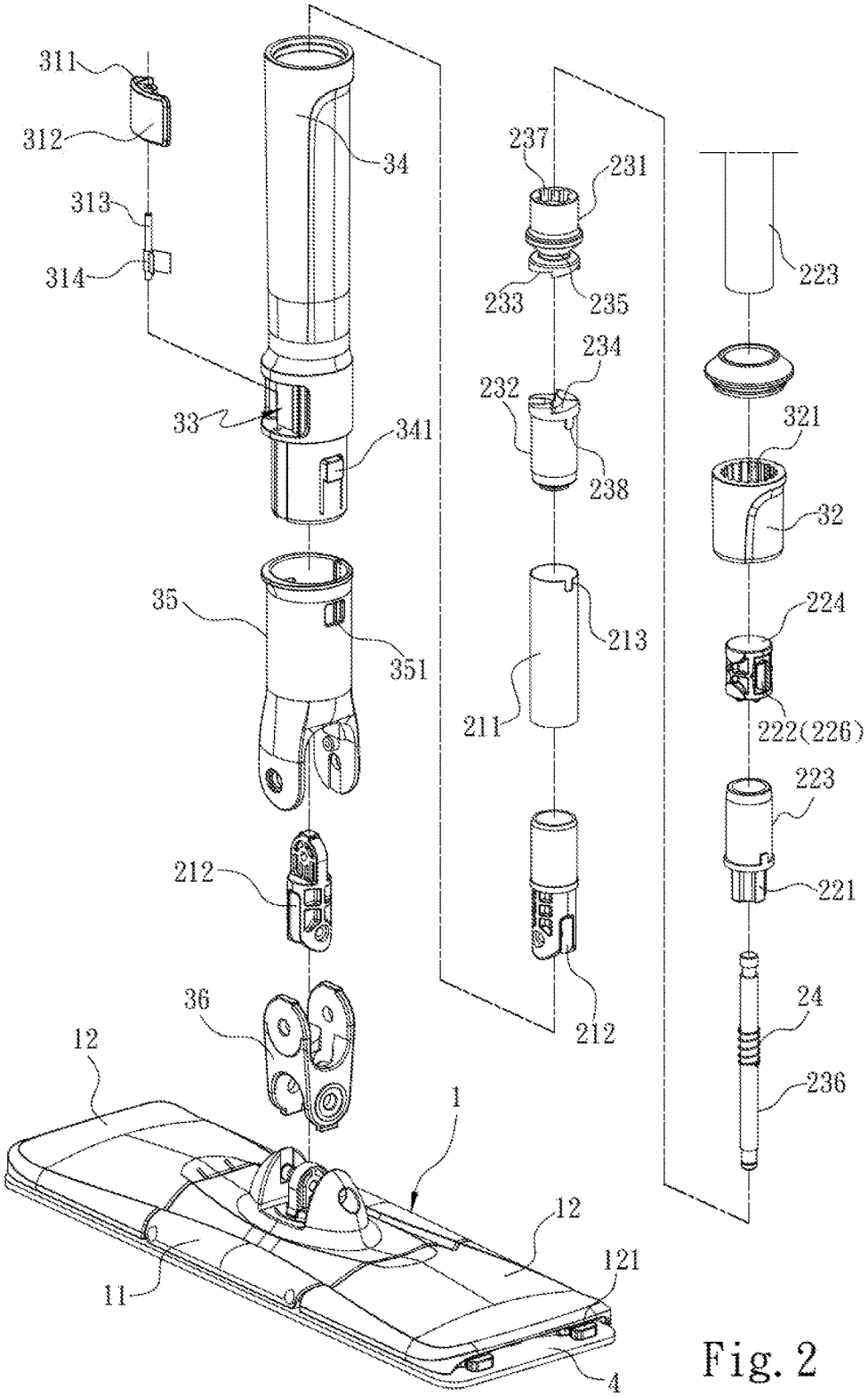
FIG. 2 is an exploded view schematically showing the structure of a self-wringing flat mop according to one embodiment of the present invention.

The technical contents of the present invention will be described in detail in cooperation with drawings below.

Referring to FIGS. 1-5, the present invention provides a self-wringing flat mop, which comprises a flat mop head 1, a mop handle 2, and a holding sleeve 3. The flat mop head 1 further comprises a central plate 11 and two side plates 12 respectively disposed at two opposite sides of the central plate 11. Two sides of the central plate 11 are respectively hinged with the two side plates 12 via torsion springs 111, whereby the each side plate 12 can turn with respect to the central plate 11. The central plate 11 includes a connection through-hole 112 formed at the substantial center thereof. Each side plate 12 includes at least one installation member 121 formed at one side of the side plate 12, which is far away from the central plate 11. A cleaning part 4 is installed at each installation member 121. The cleaning part 4 may be a piece of mop cloth. Two ends of the cleaning part 4 are respectively assembled to the two side plates 12. The cleaning part 4 includes an insertion-connection member 41 corresponding to the connection through-hole 112. In one embodiment, the insertion-connection member 41 is a hooking ring formed in the cleaning part 4. The insertion-connection member 41 is also formed at the substantial center of the cleaning part 4.

The mop handle 2 further comprises a connection rod 21 assembled to the central plate 11, a holding rod 22 disposed coaxially with the connection rod 21, configured to be held by a user during use, and a transmission assembly 23 arranged between the connection rod 21 and the holding rod 22. The transmission assembly 23 includes a first engaging member 231 and a second engaging member 232, which are able to undertake engagement-disengagement actions.

Figure 3:
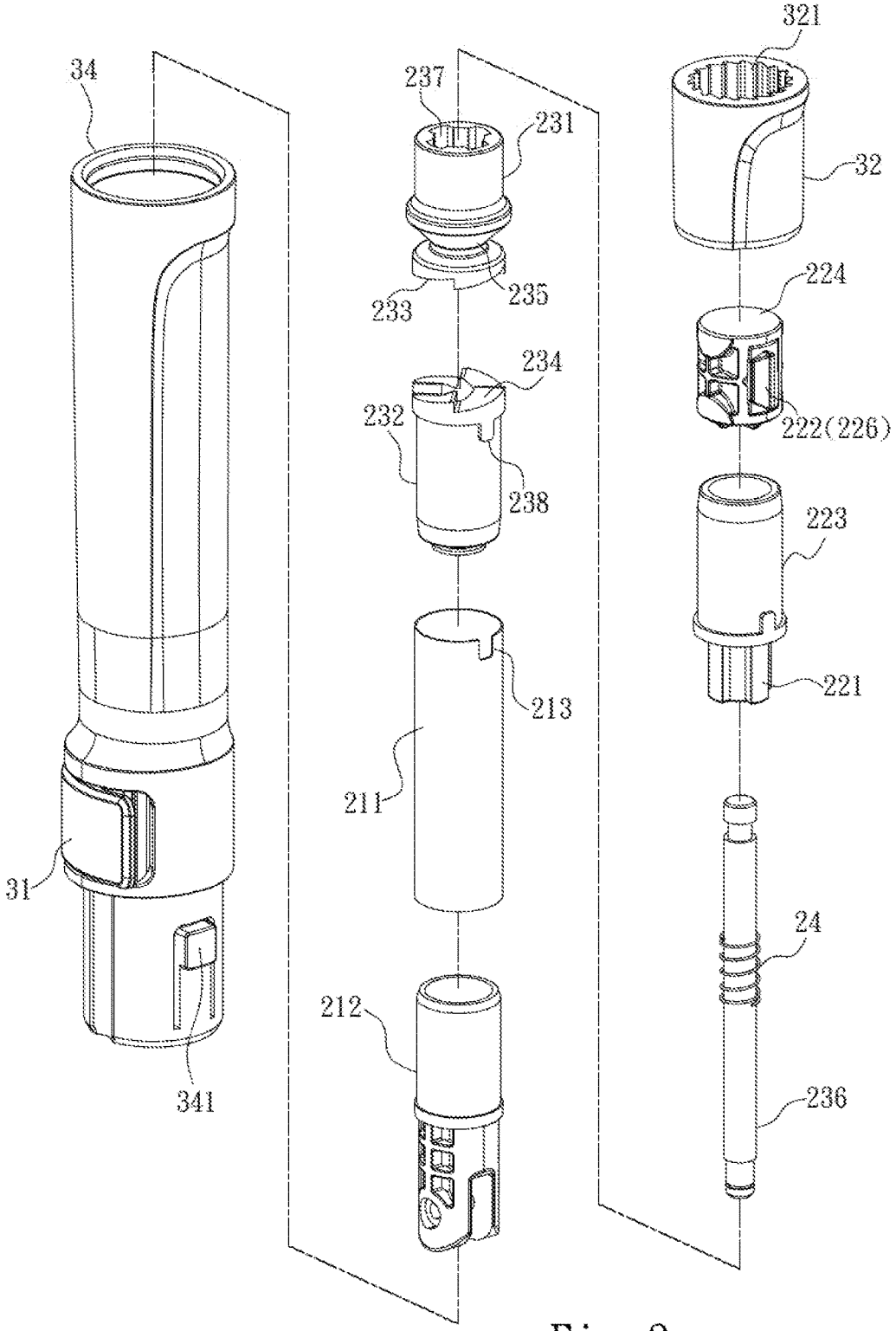
FIG. 3 is an exploded view schematically showing a portion of the structure of a self-wringing flat mop according to one embodiment of the present invention.
Figure 4:
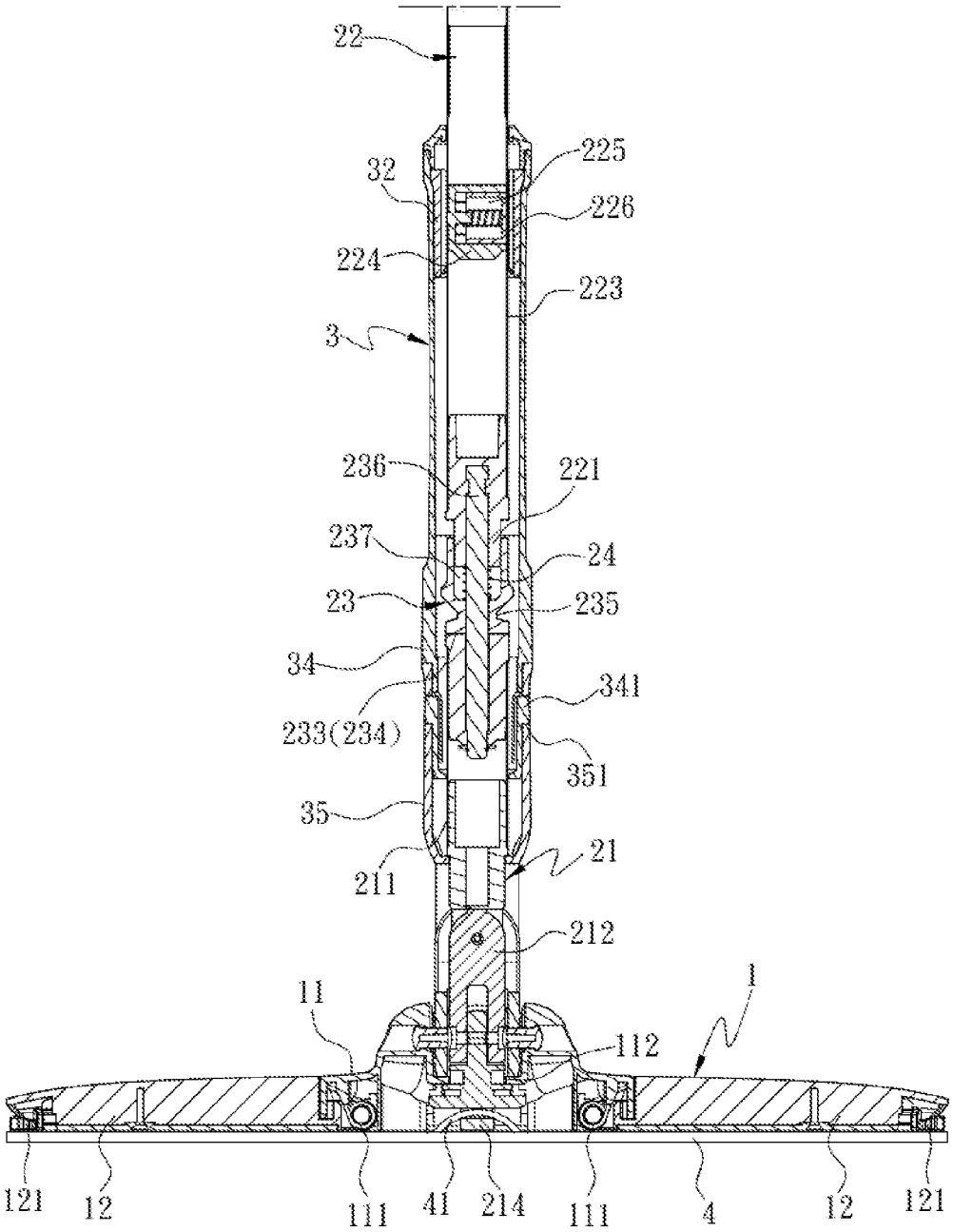
FIG. 4 is a front sectional view schematically showing a portion of the structure of a self-wringing flat mop according to one embodiment of the present invention.
Figure 5:
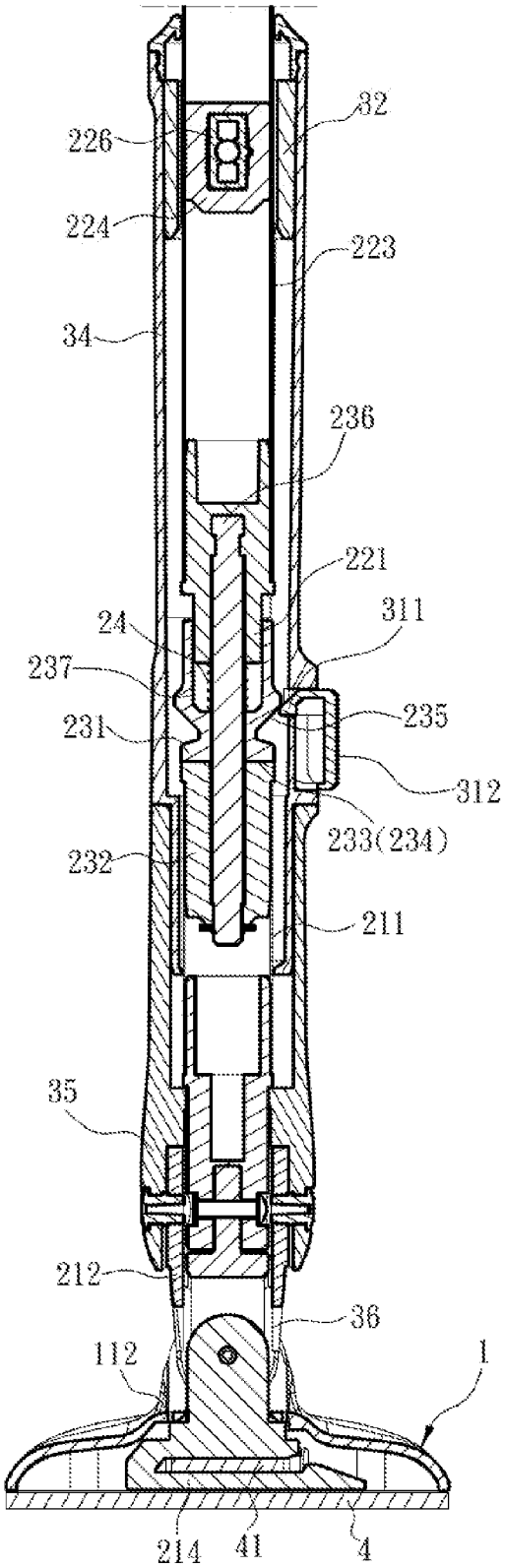
FIG. 5 is a sectional view taken from another direction to schematically show a portion of the structure of a self-wringing flat mop according to one embodiment of the present invention.

In one embodiment, the first engaging member 231 is disposed near the holding rod 22, and the second engaging member 232 is disposed near the connection rod 21, and the first engaging member 231 normally contacts the second engaging member 232. One side of the first engaging member 231, which faces the second engaging member 232, includes a first ratchet structure 233. One side of the second engaging member 232, which faces the first engaging member 231, includes a second ratchet structure 234. The first ratchet structure 233 cooperates with the second ratchet structure 234 to enable the engagement of the first engaging member 231 and the second engaging member 232 and the linked actions. The rim of the first engaging member 231 includes a guiding member 235. In one embodiment, the guiding member 235 is an inclined groove extended toward the second engaging member 232, as shown in FIG. 3 and FIG. 4.

The transmission assembly 23 further includes a guiding rod 236. One end of the guiding rod 236 is fixedly installed in the holding rod 22, and the other end of the guiding rod 236 is fixedly installed in the second engaging member 232. The first engaging member 231 sleeves the guiding rod 236 and can move along the guiding rod 236 to and fro. The mop handle 2 further comprises a first elastic element 24 disposed in one side of the holding rod 22, which faces the first engaging member 231, and pressing against the first engaging member 231. The first elastic element 24 normally provides a compressing force to the first engaging member 231 to make the first engaging member 231 normally contact the second engaging member 232. The holding rod 22 further includes a guiding ridged member 221 facing the first engaging member 231. The first engaging member 231 includes a guiding notched member 237 facing the holding rod 22 and matching the guiding ridged member 221.

Referring to FIGS. 1-5 again, the holding rod 22 includes a limiting rib 222. The holding rod 22 further includes at least two first support poles 223 and a bridging seat 224 disposed between the two first support poles 223. The bridging seat 224 has an accommodation space 225, a limiting member 226 disposed inside the accommodation space 225 and extended far away from the accommodation space 225 to form the limiting rib 222, and a second elastic element disposed inside the accommodation space 225 and pressing against the limiting member 226. From the above-mentioned description, it becomes clear that the limiting rib 222 may be formed by the limiting member 226. The connection rod 21 includes at least one second support pole 211 and a swivel joint 212 connected with the second support pole 211 and bridged with the central plate 11. One side of the second support pole 211, which faces the second engaging member 232, includes a positioning member 213 used to fix the second engaging member 232. The second engaging member 232 includes a press-fit member 238 corresponding to the positioning member 213. In one embodiment, the positioning member 213 is a notch, and the press-fit member 238 is a rib corresponding to the notch. In one embodiment, the swivel joint 212 includes a plurality of interlaced branch joints, whereby the swivel joint 212 can turn forward, backward, leftward and rightward. The connection rod 21 further includes a control member 214 penetrating the connection through-hole 112 and connected with the insertion-connection member 41. The control member 214 is disposed at one end of the connection rod 21, which faces the cleaning part 4. Further, the control member 214 is installed in the swivel joint 212 and driven by the swivel joint 212. In one embodiment, the control member 214 is designed to have a hook shape assembled to the insertion-connection member 41. While the connection rod 21 is rotated, the control member 214 drives the insertion-connection member 41 to rotate, whereby the cleaning part 4 collapses.

Referring to FIGS. 1-5 again, the holding sleeve 3 is assembled corresponding to the transmission assembly 23 and sleeves the mop handle 2. The holding sleeve 3 further comprises a control lever 31 pivotally installed with respect to the guiding member 235 and a unidirectional limiting ring 32 corresponding to the limiting rib 222. The holding sleeve 3 also includes a through-hole 33, and the control lever 31 is installed on the rim of the through-hole 33. The control lever 31 includes a protruding trigger 311 protruding from the holding sleeve 3 and contacting the guiding member 235, and a levering element 312 connected with the protruding trigger 311. In one embodiment, the control lever 31 may be manufactured as a one-piece (integral) component including the protruding trigger 311 and the levering element 312. The protruding trigger 311 is arranged inside the through-hole 33 and driven by the levering element 312 to move inside the through-hole 33 and contact the guiding member 235 of the first engaging member 231. The control lever 31 includes a pivotal axis 313 for pivotal coupling of the control lever 31 and the holding sleeve 3, and a restoring spring 314 sleeving the pivotal axis 313 and providing resilience for the levering element 312.

Figure 6:
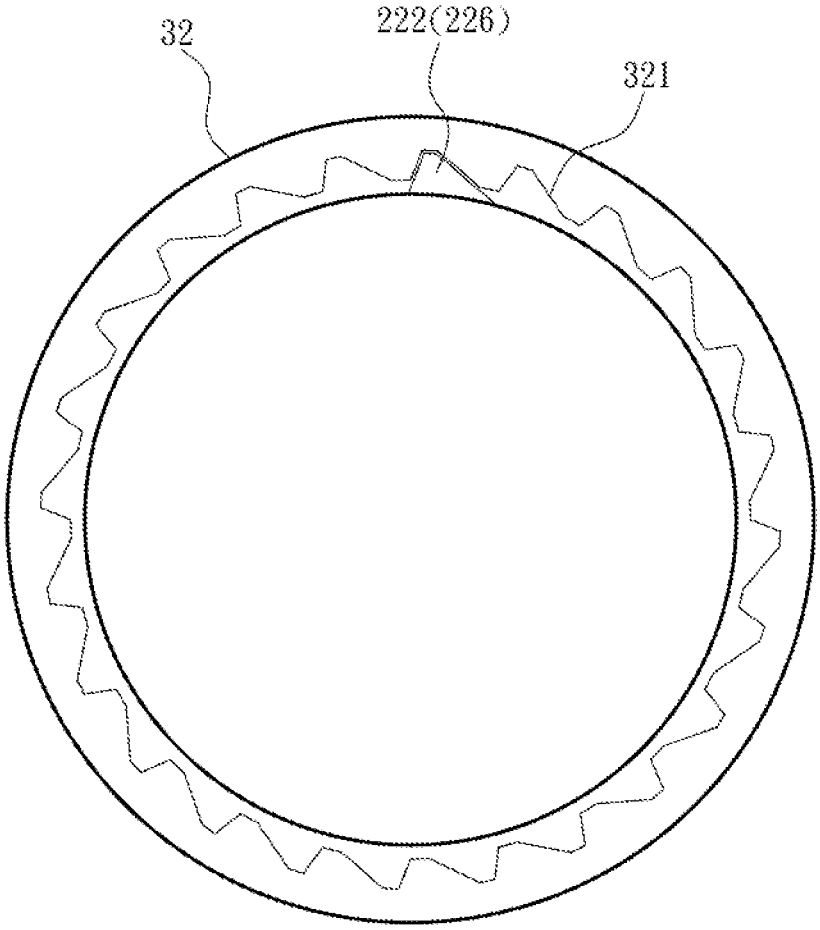
FIG. 6 is a diagram schematically showing the structure of a unidirectional limiting ring and limiting rib according to one embodiment of the present invention.

Referring to FIG. 6, the unidirectional limiting ring 32 includes a plurality of ratchet teeth 321 arranged annularly (disposed along the circumference of the limiting ring 32 at equiangular spacings) and facing the mop handle 2. The ratchet teeth 321 are disposed on the displacement path of the limiting rib 222. To this regard, the term "displacement path" means the path of the movement (or displacement) of the limiting rib 222 driven by the rotation of the holding rod 22. In other words, the limiting rib 222 protrudes toward the unidirectional limiting ring 32. Therefore, while being displaced, the limiting rib 222 slides on the ratchet teeth 321. The ratchet teeth 321 are used to confine the limiting rib 222 to slide unidirectionally. In other words, the mop handle 2 is designed to turn in a single direction without reserving.

Referring to FIGS. 2-5 again, in one embodiment, the holding sleeve 3 further comprises a sleeve body 34 where the control lever 31 and the unidirectional limiting ring 32 are disposed, a connection sleeve 35 connected with the sleeve body 34, and a protection sleeve 36 connected with the connection sleeve 35 and pivotally coupled to the central plate 11 for protecting the swivel joint 212. One end of the sleeve body 34, which faces the flat mop head 1, includes at least one press-fit protrusion 341. The connection sleeve 35 includes at least one press-fit through-hole 351 corresponding to the press-fit protrusion 341, whereby the connection sleeve 35 can be assembled to the sleeve body 34 with the press-fit through-hole 351 and the press-fit protrusion 341. The protection sleeve 36 is pivotally coupled to the connection sleeve 35 and able to rotate with the swivel joint 212.

Figure 7A:
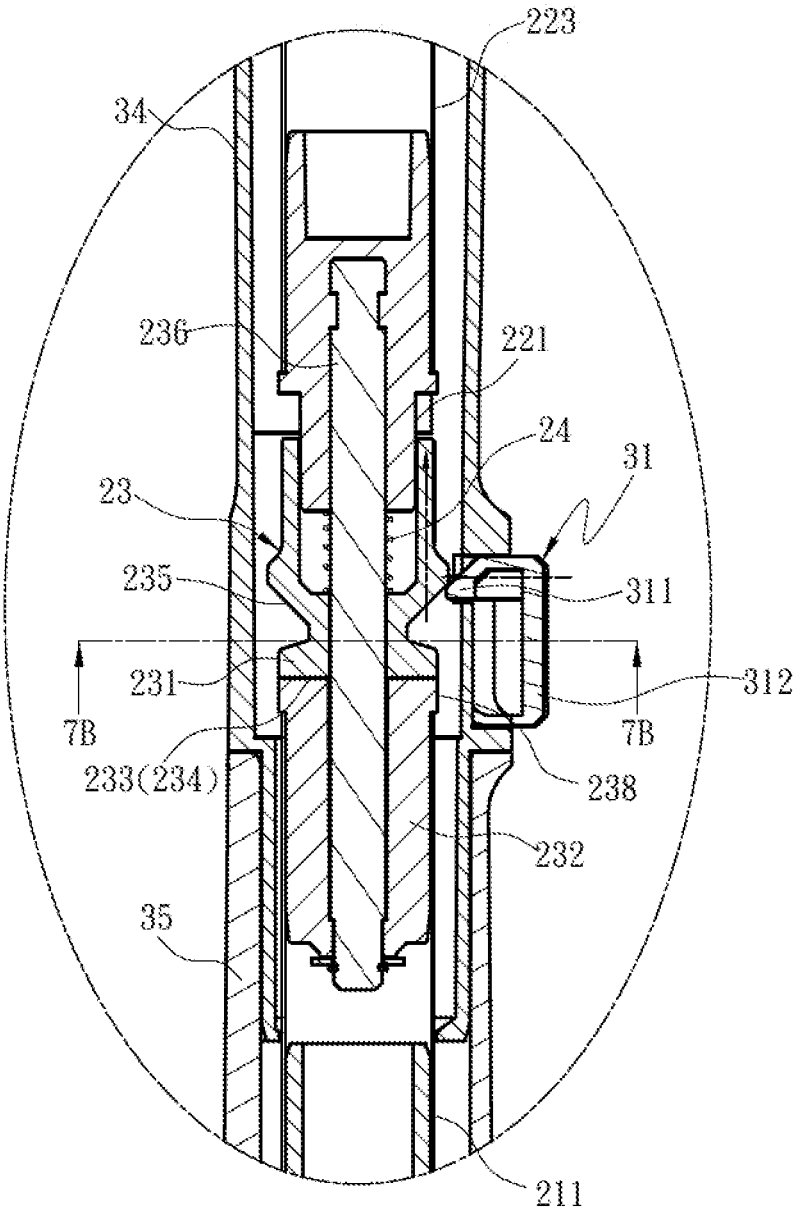
FIG. 7A is a diagram schematically showing the operation of a self-wringing flat mop according to one embodiment of the present invention.
Figure 7B:
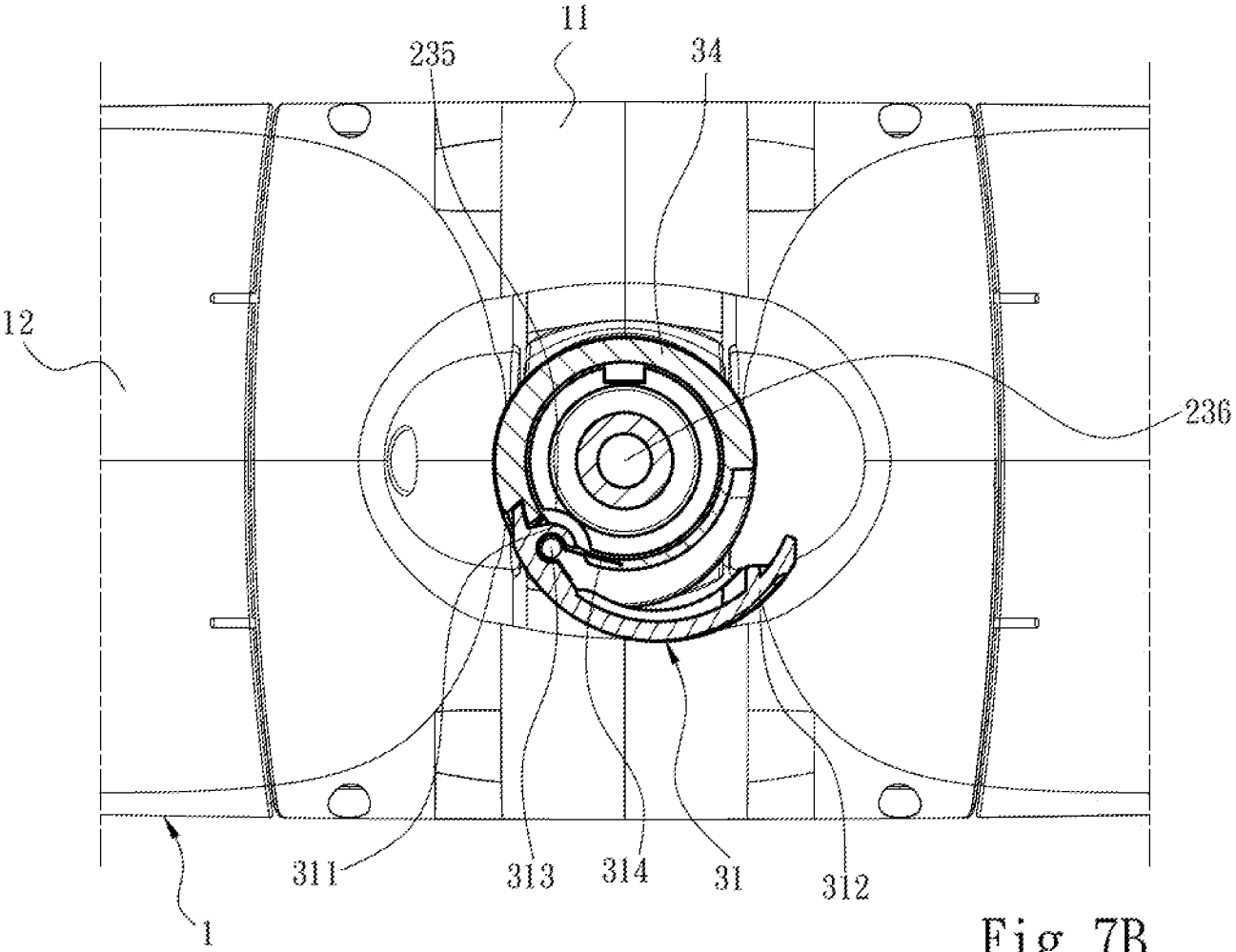
FIG. 7B is a sectional view taken from Line A-A in FIG. 7A.
Figure 7C:
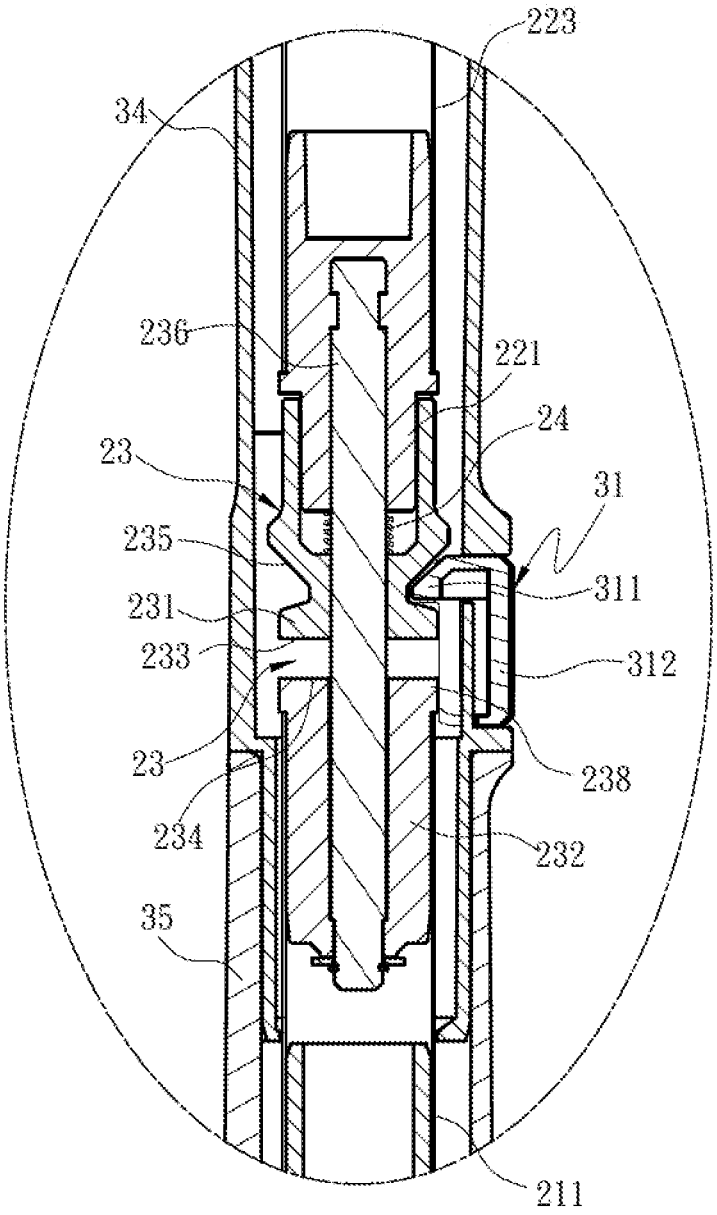
FIG. 7C is another diagram schematically showing the operation of a self-wringing flat mop according to one embodiment of the present invention.
Figure 8:
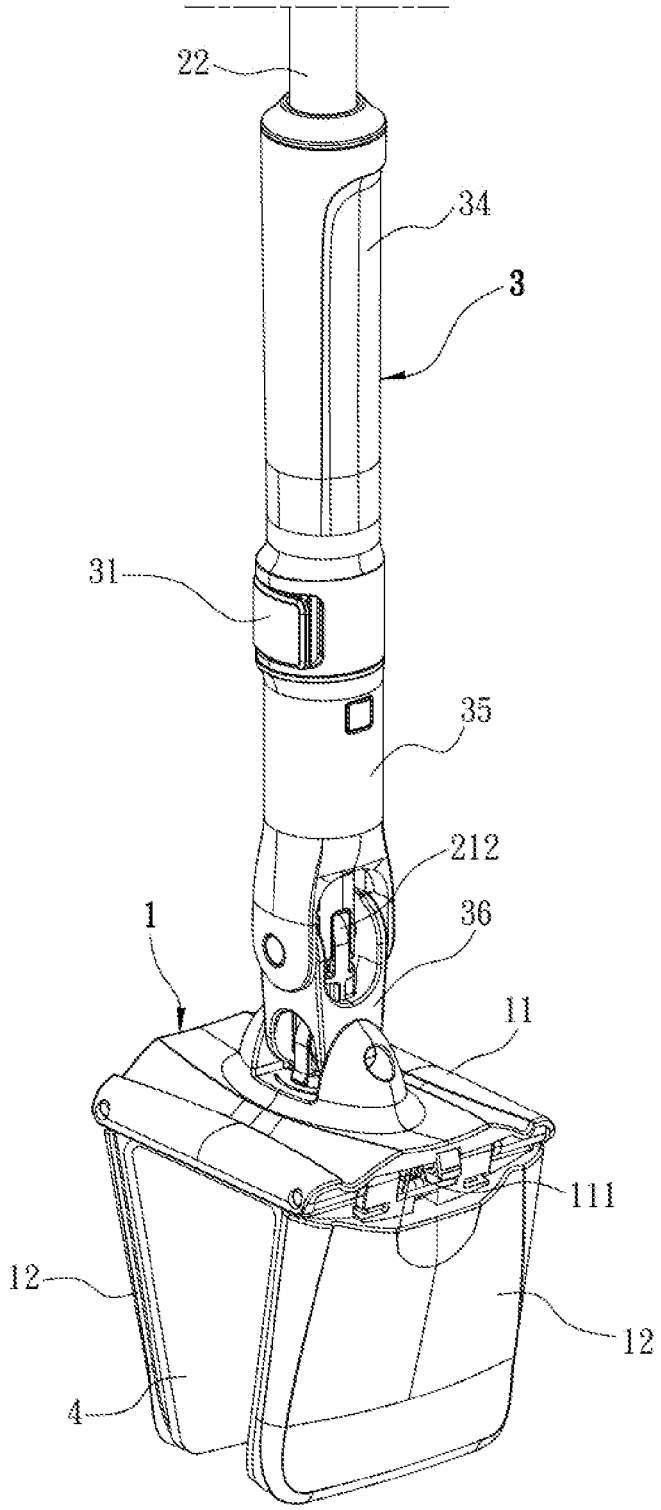
FIG. 8 is a diagram schematically showing a collapsed flat mop head of a self-wringing flat mop according to one embodiment of the present invention.

Referring to FIGS. 7A-7C, when the self-wringing flat mop is not in use, the flat mop head 1 is flattened. In such a case, the user can clean the cleaning part 4 assembled to the flat mop head 1. As the first engaging member 231 acted on by the first elastic element 24 normally contacts the second engaging member 232, the user can hold and operate the holding rod 22 to drive the connection rod 21. When the user intends to wring water out of the cleaning part 4, the user rotates the mop handle 2 to make the holding rod 22 drive the connection rod 21 through the transmission assembly 23. Thereby, the connection rod 21 rotates the control member 214, and the control member 214 rotates the insertion-connection member 41 and twists the cleaning part 4. The cleaning part 4 further twists the two side plates 12 to make the two side plates 12 collapse and move toward the central plate 11. Thus, water is wrung out of the cleaning part 4. For the details of the abovementioned process, please refer to the U.S. patent application Ser. No. 14/372,263 (published as US 2015-0113750 A1) filed with the USPTO by the Inventor, the whole content of which are hereby expressly incorporated by reference for disclosure purposes. Because of the action of the unidirectional limiting ring 32 on the limiting rib 222, the holding rod 22 cannot rotate reversely but can only rotate in a single direction lest the wringing effect be degraded.

Referring to FIGS. 7A-7C and FIG. 8, after wringing, the user applies a force to the levering element 312 to make the protruding trigger 311 slide on the guiding member 235 of the first engaging member 231, whereby the first engaging member 231 is forced (caused) to separate from the second engaging member 232. Thus, the transmission assembly 23 is in a disengagement state and unable to transmit force from the holding rod 22 to the connection rod 21. In such a case, the holding rod 22 cannot confine the connection rod 21, and the torsion springs 111 restores the two side plates 12 from the collapsed state to the flattened state. Then, the user restores the control lever 31 to the non-operating state. Thereby, the guiding member 235 of the first engaging member 231 is no more compressed by the levering element 312 of the control lever 31. Further, the first engaging member 231 is pressed by the first elastic element 24 to contact the second engaging member 232 once again. Thus, the self-wringing flat mop is ready for the next cycle of wringing.

What is claimed is:

1. A self-wringing flat mop, comprising:

a flat mop head further comprising a central plate and two side plates, wherein two sides of the central plate are respectively hinged with the two side plates via torsion springs, and wherein the central plate includes a connection through-hole formed at the center thereof;

a cleaning part whose two ends are respectively assembled to the two side plates, including an insertion-connection member corresponding to the connection through-hole;

a mop handle further comprising a connection rod assembled to the central plate, a holding rod disposed coaxially with the connection rod, and a transmission assembly disposed between the connection rod and the holding rod, wherein the connection rod includes a control member penetrating the connection through-hole and connected with the insertion-connection member, and wherein the holding rod is configured to be operated to generate a rotation, and the transmission assembly is configured for transmitting the rotation to the connection rod, and wherein the connection rod turns the cleaning part through the control member to make the two side plate collapse and wring water out of the cleaning part, and wherein the transmission assembly includes a first engaging member and a second engaging member, and wherein the first engaging member normally contacts the second engaging member, and wherein a rim of the first engaging member has a guiding member, and wherein the holding rod includes a limiting rib; and holding sleeve sleeving the mop handle and assembled corresponding to the transmission assembly, said holding sleeve further comprising a control lever pivotally installed with respect to the guiding member, and a unidirectional limiting ring corresponding to the limiting rib, wherein the control lever includes a protruding trigger protruding from the holding sleeve and contacting the guiding member, and a levering element connected with the protruding trigger, and wherein the levering element is turned pivotally with respect to the holding sleeve to make the protruding trigger slide on the guiding member and separate the first engaging member from the second engaging member, and wherein the unidirectional limiting ring includes a plurality of ratchet teeth arranged annularly and facing the mop handle, and wherein the ratchet teeth confine the limiting rib to slide unidirectionally and confine the mop handle to turn in a single direction.

2. The self-wringing flat mop according to claim 1, wherein the transmission assembly comprises a guiding rod, wherein one end of the guiding rod is fixedly installed in the holding rod, and the other end of the guiding rod is fixedly installed in the second engaging member, and wherein the first engaging member sleeves the guiding rod and can move along the guiding rod to and fro.

3. The self-wringing flat mop according to claim 2, wherein the holding rod comprises at least two first support poles and a bridging seat disposed between the two first support poles, and wherein the bridging seat comprises an accommodation space, a limiting member disposed inside the accommodation space and extended far away from the accommodation space to form the limiting rib, and a second elastic element disposed inside the accommodation space and pressing against the limiting member.

4. The self-wringing flat mop according to claim 1, wherein the mop handle comprises a first elastic element disposed in one side of the holding rod, which faces the first engaging member, and pressing against the first engaging member.

5. The self-wringing flat mop according to claim 4, wherein the holding rod comprises a guiding ridged member facing the first engaging member, and wherein the first engaging member comprises a guiding notched member facing the holding rod and matching the guiding ridged member.

6. The self-wringing flat mop according to claim 5, wherein the connection rod comprises at least one second support pole and a swivel joint connected with the second support pole and bridged with the central plate, and wherein one side of the second support pole, which faces the second engaging member, comprises a positioning member used to fix the second engaging member, and wherein the second engaging member comprises a press-fit member corresponding to the positioning member.

7. The self-wringing flat mop according to claim 6, wherein the swivel joint includes a plurality of interlaced branch joints.

8. The self-wringing flat mop according to claim 6, wherein the holding sleeve comprises a sleeve body where the control lever and the unidirectional limiting ring are disposed, a connection sleeve connected with the sleeve body, and a protection sleeve connected with the connection sleeve and pivotally coupled to the central plate for protecting the swivel joint.

9. The self-wringing flat mop according to claim 4, wherein the holding rod comprises at least two first support poles and a bridging seat disposed between the two first support poles, and wherein the bridging seat comprises an accommodation space, a limiting member disposed inside the accommodation space and extended far away from the accommodation space to form the limiting rib, and a second elastic element disposed inside the accommodation space and pressing against the limiting member.

10. The self-wringing flat mop according to claim 1, wherein the holding rod comprises a guiding ridged member facing the first engaging member, and wherein the first engaging member comprises a guiding notched member facing the holding rod and matching the guiding ridged member.

11. The self-wringing flat mop according to claim 10, wherein the connection rod comprises at least one second support pole and a swivel joint connected with the second support pole and bridged with the central plate, and wherein one side of the second support pole, which faces the second engaging member, comprises a positioning member used to fix the second engaging member, and wherein the second engaging member comprises a press-fit member corresponding to the positioning member.

12. The self-wringing flat mop according to claim 11, wherein the swivel joint includes a plurality of interlaced branch joints.

13. The self-wringing flat mop according to claim 11, wherein the holding sleeve comprises a sleeve body where the control lever and the unidirectional limiting ring are disposed, a connection sleeve connected with the sleeve body, and a protection sleeve connected with the connection sleeve and pivotally coupled to the central plate for protecting the swivel joint.

14. The self-wringing flat mop according to claim 1, wherein the holding rod comprises at least two first support poles and a bridging seat disposed between the two first support poles, and wherein the bridging seat comprises an accommodation space, a limiting member disposed inside the accommodation space and extended far away from the accommodation space to form the limiting rib, and a second elastic element disposed inside the accommodation space and pressing against the limiting member.

15. The self-wringing flat mop according to claim 1, wherein the control lever comprises a pivotal axis for pivotal coupling of the control lever and the holding sleeve, and a restoring spring sleeving the pivotal axis and providing resilience for the levering element.

16. The self-wringing flat mop according to claim 1, wherein one side of the first engaging member, which faces the second engaging member, comprises a first ratchet structure, and wherein one side of the second engaging member, which faces the first engaging member, comprises a second ratchet structure.

* * * * *